US005195336A

United States Patent [19]

Mershon

[11] Patent Number: 5,195,336

[45] Date of Patent: Mar. 23, 1993

[54] INTERCHANGEABLE ORNAMENTS

[76] Inventor: Randolph J. Mershon, 300 Winston Dr., Cliffside Park, N.J. 07010

[21] Appl. No.: 867,308

[22] Filed: Apr. 10, 1992

[51] Int. Cl.[5] ..... A44C 17/02

[52] U.S. Cl. ..... 63/29.1

[58] Field of Search ..... 63/29.1, 1.1, 2

[56] References Cited

U.S. PATENT DOCUMENTS

| | | | |
|---|---|---|---|
| 2,654,927 | 10/1953 | Tansman | 63/29.1 |
| 2,752,764 | 7/1956 | Lederer | 63/29.1 |
| 2,778,136 | 1/1957 | Belgard | 63/29.1 |
| 2,983,975 | 5/1961 | Hubbell | 63/29.1 |
| 3,088,295 | 5/1963 | Haines | 63/29.1 |
| 3,509,734 | 5/1970 | Lederer | 63/15 |
| 4,130,950 | 12/1978 | Bazzle et al. | 36/127 |
| 4,195,492 | 4/1980 | Johnson | 63/29.1 |
| 4,453,294 | 6/1984 | Morita | 24/303 |
| 4,621,441 | 11/1986 | Wagner et al. | 40/2 E |
| 4,712,319 | 12/1987 | Goria | 36/137 |
| 4,793,155 | 12/1988 | Law | 63/29.1 |
| 4,899,556 | 2/1990 | Ford | 63/29.1 |
| 4,912,944 | 4/1990 | Crosley et al. | 63/29.2 |
| 4,959,890 | 10/1990 | Pazurek | 63/29.1 |
| 4,982,581 | 1/1991 | Furuyama | 63/29.1 |

FOREIGN PATENT DOCUMENTS

| | | | |
|---|---|---|---|
| 490216 | 4/1919 | France | 63/29.1 |
| 608150 | 7/1926 | France | 63/29.1 |
| 1191786 | 10/1959 | France . | |
| 238894 | 11/1945 | Switzerland | 63/29.1 |

*Primary Examiner*—Michael F. Trettel
*Assistant Examiner*—Michael T. Milano
*Attorney, Agent, or Firm*—Cesari and McKenna

[57] ABSTRACT

A device for supporting detachable, interchangeable ornaments that may be used in conjunction with a wide range of apparel including shoes, garments and accessories. The device utilizes complementary hook-and-pile fastening materials. One component (preferably the pile) seated at the base of a receptacle, which serves as the anchor, and the other component is recessed within a cap that fits over the receptacle and also supports the ornament. The hook-and-pile components meet when the cap is mated over the receptacle. This arrangement prevents rotation of the cap and reliably secures it to the receptacle.

6 Claims, 1 Drawing Sheet

INTERCHANGEABLE ORNAMENTS

BACKGROUND OF THE INVENTION

1. Field of the Invention

The present invention relates to ornamentation of shoes, garments and accessories, and in particular to a system for supporting detachable, interchangeable ornaments that may be used in conjunction with a wide range of apparel.

2. Description of the Related Art

Leather and manufactured goods (such as handbags and shoes) and apparel frequently feature various forms of ornamentation, such as inexpensive or imitation stones, sequins or decorative metal buttons. In addition to a purely decorative role, such ornaments may serve as clasps, catches or fulfill other functional purposes. Typically, the manufacturer of a decorated article sews the ornaments directly onto the material of the article. This practice affords permanence and durability, but obviously restricts the wearer to the arrangement as sold.

To provide greater ornamental flexibility, designers have for years utilized ornament bases that contain integral magnets, freeing the customer (or the manufacturer, prior to shipment) to substitute one ornament for another. For example, U.S. Pat. No. 2,752,764 describes earrings whose bases contain small magnets. The base serves as an anchor, attracting the ornament magnetically and providing a shoulder over which the ornament may be snugly fitted.

Magnets suffer from several disadvantages as attachments to garments. First, because ornaments tend to differ in size and footprint, it becomes necessary to produce a separate magnet for each type or class of ornament. Unless the magnets are ordered in great quantity, this can prove expensive.

Second, magnetically secured ornaments are most often round, since this shape offers greatest convenience for placement and removal. But a round ornament will rotate about a central axis, and unless it is cylindrically symmetric, the ornament will tend toward an awkward appearance as it rotates from its intended orientation. The magnet can be made off-round to limit rotation, but this approach increases the cost of the magnet and may limit its convenient use.

Third magnets can attract foreign metal objects whose accumulation degrades the appearance of the ornaments and may cause damage thereto.

DESCRIPTION OF THE INVENTION

The present invention overcomes the limitations associated with magnetic devices through the use of complementary hook-and-pile fastening materials. One component (preferably the pile) is seated at the base of a receptacle, which serves as the anchor and is secured to the ornamented article as described below. The other component is recessed within a cap that fits over the receptacle and also supports the ornament, so that the hook-and-pile components meet when the cap is mated over the receptacle. This arrangement prevents rotation of the cap and reliably secures it to the receptacle.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE INVENTION

Figure 1A:
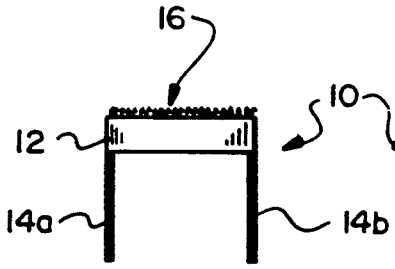
FIG. 1A is an elevational view of representative receptacle of the present invention.
Figure 1B:
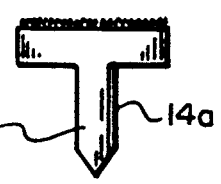
FIG. 1B is another elevational view rotated 90 degrees of the receptacle depicted in FIG. 1A.

Refer first to FIGS. 1A and 1B, in which reference numeral 10 denotes generally a base member comprising a cup portion 12, having an outer rim that surrounds a floor and two prongs 14*a*, 14*b*. Secured to the base of cup 12 is conforming patch 16 of one component of a hook-and-pile fastening material, such as VELCRO® or the like. Patch 16, which is preferably the pile component of the fastening material, is anchored to the floor of cup 12 by adhesive a rivet or other suitable means. Prongs 14*a*, 14*b* fit through slits in the article that will receive the ornament, and are then folded to clamp base 10 to that article.

Figure 2:
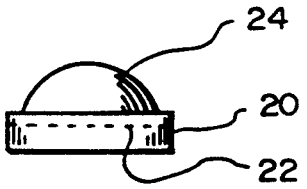
FIG. 2 is an elevational view of an ornament-bearing cover that fits over the receptacle shown in FIGS. 1A and 1B.
Figure 3:
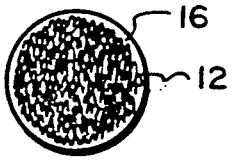
FIG. 3 is a plan view of the receptacle shown in FIGS 1A and 1B.
Figure 4:
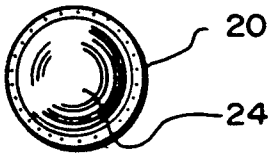
FIG. 4 is a plan view of the cover shown in FIG. 2.

A complementary cap 20, as shown in FIG. 2, includes an outer rim and a ceiling. Cap 20 contains a conforming patch of 22 of the complementary hook-and-pile material, which is recessed and secured to the ceiling of cap 20, once again, by adhesive, a rivet or other suitable means. Cap 20 supports an ornament 24 on its outer face. When cup 20 is mated over base 12, hook-and-pile patches 16 and 22 engage one another, immobilizing cap 20 to prevent rotation or disengagement from base 10.

Figure 5A:
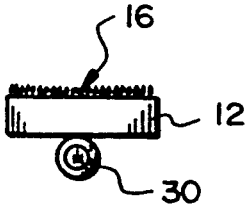
FIG. 5A is an elevational view an alternative embodiment of the receptacle of the present invention.
Figure 5B:
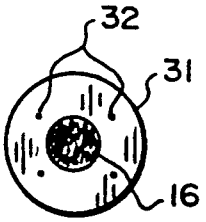
FIG. 5B is plan view of a variation of the embodiment illustrated in FIG. 5A.

In an alternative embodiment, illustrated in FIG. 5, the prongs of base 10 have been replaced with a sewing loop 30, which may be sewn onto the face of a garment in the manner of a button. Indeed, it is possible to further conform the base of the present invention to the style of a standard button by restricting the size of the hook-and-pile patch and surrounding it with sew holes. This approach is shown in FIG. 5B. The diameter of patch 16 has been reduced so that it sits within a depression in the center of a disk 31, which is otherwise relatively flat. Disk 31 also contains four sewing channels denoted generally by reference numeral 32 (and which can be replaced with a sewing loop, as shown in FIG. 5A). The ornament fits over disk 31 in the manner described above with respect to the other embodiments.

Figure 6:
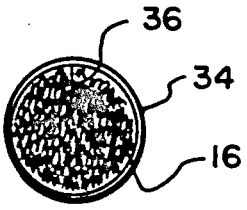
FIG. 6 is a plan view of another alternative embodiment of the receptacle of the present invention.

In a further variation, illustrated in FIG. 6, cup 12 is replaced with a ring 36 having an inwardly facing, annular lip 36 along its top portion. Ring 34 is attached to the ornamented article in the manner described above in connection with cup 12. Instead of containing the patch 16, the ring merely covers and holds it in place.

It will therefore be seen that I have developed an improved device for placement of interchangeable ornaments, which can support a variety of ornament styles and shapes and may be affixed to any number of different articles. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed. For example, a wide variety of alternative mounting structures are available, such as adhesive applied to a surface of the base member or a series of nail heads depending directly from the base member.

What is claimed is:

1. A device for securing an ornament, comprising:

a. an arbitrarily shaped cap for supporting the ornament, the cap comprising:

1) a ceiling;

2) a rim depending from the ceiling; and 3) a patch of one component of a hook-and-pile fastening material, the patch having a shape conforming to that of the cap, secured to the ceiling and surrounded by the rim;

b. a base shaped to fit within the rim of the cap, and comprising:

1) a floor;

2) a rim depending from the floor and which fits snugly within the rim of the cap;

3) a patch of the complementary component of a hook-and-pile fastening material, the patch having a shape conforming to that of the base, secured to the floor and surrounded by the rim; and 4) means to facilitate mounting of the base to an article.

2. The device of claim 1 wherein the means for mounting the base is a pair of prongs depending from the rim of the base.

3. The device of claim 1 wherein the means for mounting the base is a button loop.

4. A device for securing an ornament, comprising:

a. an arbitrarily shaped cap for supporting the ornament, the cap comprising:

1) a ceiling;

2) a rim depending from the ceiling; and 3) a patch of one component of a hook-and-pile fastening material, the patch having a shape conforming to that of the cap, secured to the ceiling and surrounded by the rim;

b. a base shaped to fit within the rim of the cap, and comprising:

1) a ring having an annular rim and which fits snugly within the rim of the cap;

2) a path of the complementary component of a hook-and-pile fastening material, the patch having a shape conforming to that of the base so as to fit within the ring and surrounded by the rim; and 3) means to facilitate mounting of the ring to an article.

5. The device of claim 4 wherein the means for mounting the base is a pair of prongs depending from the rim of the base.

6. A device for securing an ornament, comprising:

a. an arbitrarily shaped cap for supporting the ornament, the cap comprising:

1) a ceiling;

2) a rim depending from the ceiling; and 3) a patch of one component of a hook-and-pile fastening material, the patch having a shape conforming to that of the cap and secured to the ceiling and surrounded by the rim;

b. a disk shaped to fit snugly within the rim of the cap, and comprising:

1) a generally flat surface having a central depression within a rim;

2) a path of the complementary component of a hook-and-pile fastening material, the patch having a shape conforming to that of the depression and mounted therein and surrounding the rim; and e) means to facilitate sewing of the disk to an article.

* * * * *